United States Patent [19]

Secolo et al.

[11] Patent Number: 4,589,177

[45] Date of Patent: May 20, 1986

[54] METHOD OF MANUFACTURING, WITHOUT WELDING, LIGHT ALLOY RIMS FOR MOTOR VEHICLES

[75] Inventors: Nunzio Secolo; Elio Gualchi, both of Turin, Italy

[73] Assignee: Teksid S.p.A., Turin, Italy

[21] Appl. No.: 735,820

[22] Filed: May 17, 1985

Related U.S. Application Data

[63] Continuation-in-part of Ser. No. 389,805, Jun. 18, 1982, abandoned.

[30] Foreign Application Priority Data

Feb. 25, 1982 [IT] Italy ..... 67203 A/82

[51] Int. Cl.[4] ..... B21K 1/38

[52] U.S. Cl. ..... 29/159.1; 29/159 R; 72/105

[58] Field of Search ..... 29/159 R, 159.1, 159.01; 72/68, 84, 85, 105; 301/63 R

[56] References Cited

U.S. PATENT DOCUMENTS

| | | | |
|---|---|---|---|
| 1,442,240 | 1/1923 | Stone | 29/160.6 |
| 2,185,347 | 1/1940 | LeJeune | 29/159.1 |
| 3,440,705 | 4/1969 | Johnson | 29/159 R |
| 3,667,265 | 6/1972 | Zippe | 72/105 |
| 4,185,370 | 1/1980 | Evans | 29/159.1 |

FOREIGN PATENT DOCUMENTS

| | | | |
|---|---|---|---|
| 130413 | 12/1945 | Australia | 29/159.1 |
| 1422747 | 1/1976 | United Kingdom | 29/159.1 |
| 774729 | 11/1980 | U.S.S.R. | 29/159 R |

*Primary Examiner*—Howard N. Goldberg
*Assistant Examiner*—P. W. Echols

[57] ABSTRACT

A method of manufacturing a wheel rim for a motor vehicle, including cutting off a section of an extruded cylindrical tube to produce a hollow cylindrical rim blank, and subjecting the blank to two successive deformation steps. During the first step, only the central section of the blank is deformed radially inwardly, the diameter of the end sections remaining substantially unchanged. In the second step, only the edge portions of each end section are deformed radially outwardly, so that the region between each edge portion and the central section is unchanged in diameter. Also, the outermost part of each edge of the blank is bent into a U-shape. The rim is then gauged to finish it. The first deformation step is performed by a pair of cooperating rollers having central sections shaped to deform the central section of the blank. The end sections of the rollers are spaced apart to accommodate the end sections of the blank, the spaces being open at the sides of the rollers to permit free endwise flow of the rim blank outwardly from between the rollers.

3 Claims, 4 Drawing Figures

METHOD OF MANUFACTURING, WITHOUT WELDING, LIGHT ALLOY RIMS FOR MOTOR VEHICLES

This application is a continuation-in-part of copending application Ser. No. 389,805, filed June 18, 1982 now abandoned.

In a known process for manufacturing light alloy wheels for motor vehicles, the rim is obtained by rolling a ring, which is closed by external longitudinal welding. This process, while offering significant advantages concerning the reduction of the total wheel weight, presents the drawback of the longitudinal welding of the rim, which while technically feasible, requires a working cycle which is relatively complex.

Among the different particular features required of wheels for motor vehicles, the special ones are limited weight and moment of inertia, as well as rapid withdrawal of the heat generated by the tire and the brake disk or drum, generally applied to the wheel hub.

It is also known that motor vehicle wheels comprise a rim, on to which the tire is mounted, and a disk or a radial member. The latter part may be manufactured separately from the rim and subsequently assembled with it, or it may be integral with the rim and the hub.

The present state of technology is preferentially oriented to the manufacture of light alloy wheels, particularly for equiping motor cars, because such wheels better answer the aforesaid technical requirements. According to the present trend, wheels are known which are of molded light alloy, diecast, low-pressure cast, or centrifuged, their weight being a little lower than that of steel press-forged wheels.

Pressed monolithic light alloy wheels are also known, but the employment of such wheels is limited due to their high cost; while they present good mechanical features, better than those of the molded wheels, their cost is nearly double that of molded wheels.

With these considerations in mind, the main object of the present invention is to provide a process for the manufacture of light alloy wheel rims which can later be assembled with disks to form the complete wheels.

A further object of the invention is to provide light alloy wheel rims, particularly for motor vehicles, having minimum weight due to the material used, and which do not require any external longitudinal welding.

In view of the above mentioned objectives, the present invention provides a process for the manufacture of wheel rims for motor vehicles, characterized in that each rim is obtained by rolling and gauging a cylinder segment having pre-established dimensions and cut from an extruded tube of aluminum or other light alloy. As a result, the finished rim does not require any longitudinal welding and has no gaps along the length of its skirt.

More specifically, an object of this invention is to produce light alloy rims, particularly for the manufacture of wheels for high speed motor vehicles which must be provided with wheel rims having a homogeneous resistance along the whole structure of the crown, and must have a perfect circularity, especially if they are to be used with "tubeless" tires.

In view of the above-mentioned object, the present invention is characterized by subjecting a cylindrical element having no radial welding to two distinct deformation steps accomplished by rolling, namely:

a first step in which the cylindrical element is subjected to rolling to shape only the central section, in such a way that the two symmetrical and cylindrical end sections on opposite sides of the central section are not subjected to any deformation; and a second step in which the region of each cylindrical end section directly adjacent to the central section does not undergo any deformation, but the edge portion of each end section is deformed in order to form the sides of the rim, designed to hold the tire, while the outermost parts of the edge portions become "U" shaped, thus forming parallel and opposed rigid edges and also the hidden seat where the wheel balancing weights of the finished wheel are fitted.

The invention will now be described by way of example, with reference to the schematic drawings herewith annexed, in which.

Figure 1:
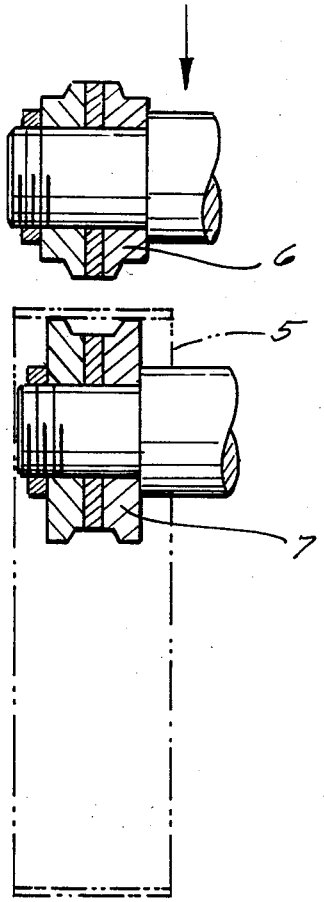
FIG. 1 is a cross-sectional view, in a vertical plane, of rollers employed to perform the first deformation step on a light alloy cylindrical rim blank obtained by cutting from an extruded tube.
Figure 2:
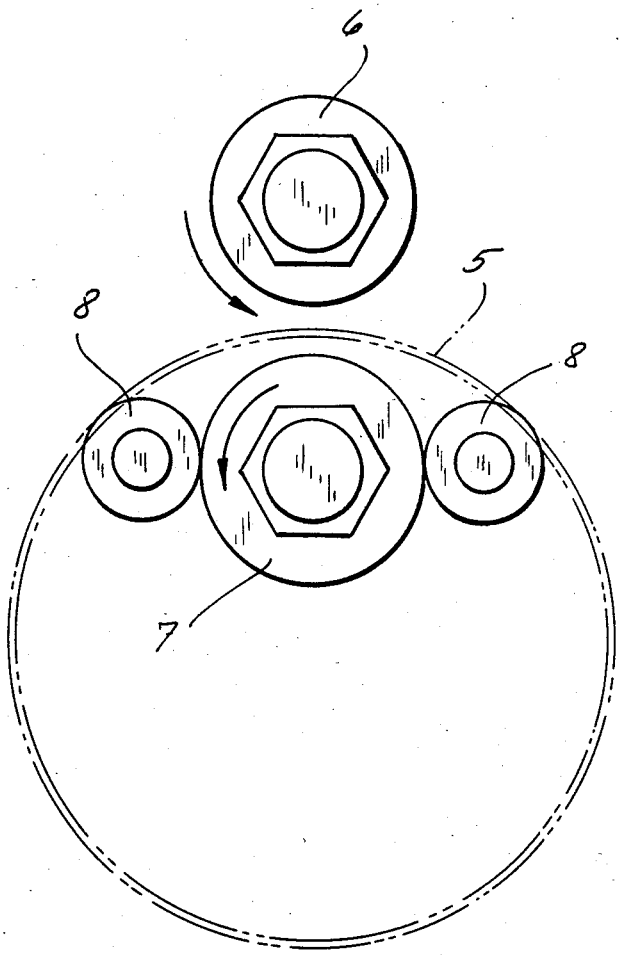
FIG. 2 is a side elevational view of the rollers of FIG. 1.

Referring to FIGS. 1 and 2 of the drawings, a hollow cylindrical rim blank 5 is arranged to be deformed by a pair of rollers 6 and 7 having complementary profiles. Rollers 6 and 7 are employed to implement a first step of deformation of the rim blank 5. During this deformation, the blank is supported by guide rollers 8.

Figure 3:
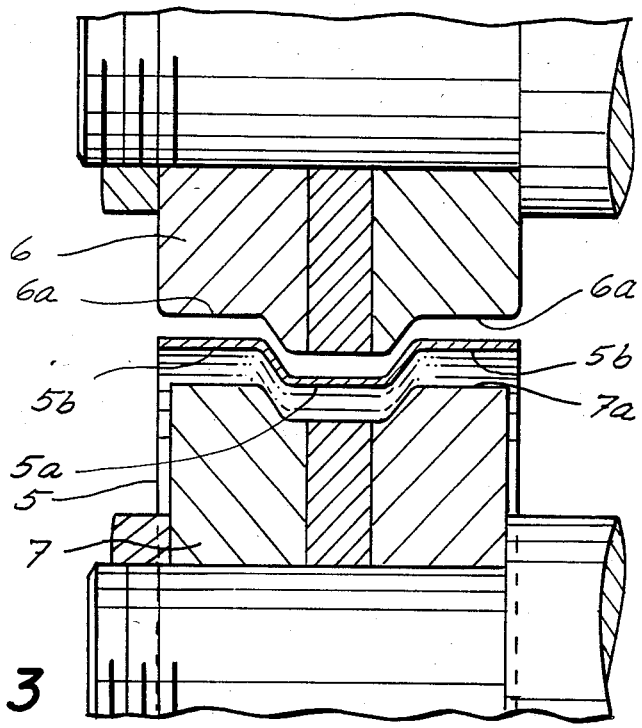
FIG. 3 is a fragmentary view, on an enlarged scale, of a portion of the rollers of FIG. 1 showing the central section of the rim blank deformed after undergoing the first step of rolling.

As shown in FIG. 3, during the first phase of rolling, the blank 5 is deformed only in its central section in order to shape the perimetrical groove 5*a*. The end sections 5*b* of the blank, accommodated between the flat and parallel end sections 6*a* and 7*a* of the rollers 6 and 7, are not subjected to any such radial deformation, i.e., the diameters of the end sections remain substantially unchanged.

Figure 4:
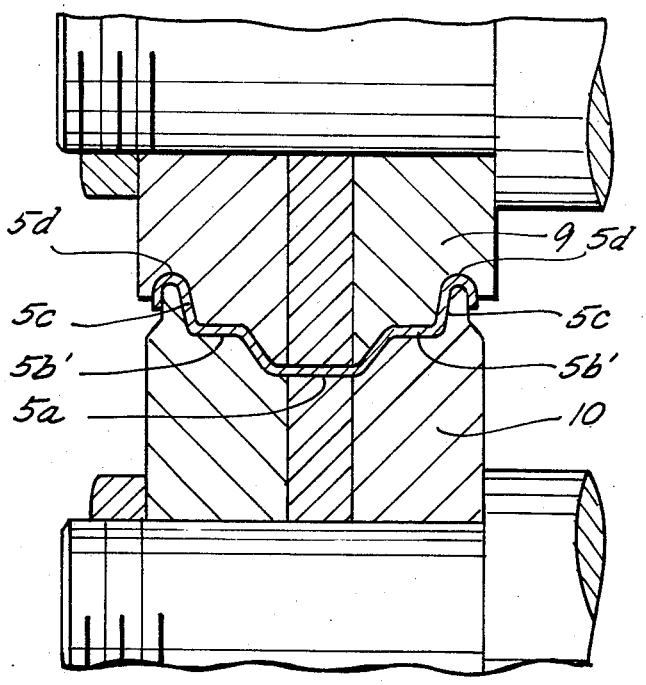
FIG. 4 is a view similar to FIG. 3 showing the rim and the rollers employed during the second step of rolling, which concludes the shaping of the rim according to the present invention.

During the second deformation step, rollers 9 and 10 are employed, having a complementary profile as shown in FIG. 4.

During this second step, a region of each of the end sections 5*b*, which had not undergone any deformation during the first step, still remains undeformed, as shown at 5*b'* in FIG. 4. However, the edge portions 5*c* are deformed in order to shape the lateral retaining sides for the tire, the latter being seated within the region 5*b'*. Adjacent the seat for the tire, the outermost part 5*d* of each edge of the blank is turned into a "U" section. The "U" profiled edges, besides forming the hidden and protected location for holding the known wheel balancing weights, also produce a pair of parallel and circumferential ribs which strengthen the sides of the finished rim.

The procedure for finishing the rim ends with the gauging of each piece.

The advantages derived from the above-described process are the following:

the two regions of the finished rim, indicated with 5*b'* in FIG. 4, are maintained at the original diameter of the cylindrical rim blank 5, obtained by cutting from an extruded tube; since these regions are not subjected to any deformation and therefore to any "stress", perfect circularity of the seat for the tire lips is guaranteed, which is a very important fact, especially for "tubeless" tires;

the sections 5*a* and 5*d* take their shape with relatively low "stress" on the metal, particularly as compared to known processes;

the above-mentioned process employs rollers 6 and 7, in which the spaces between sections 6*a* and 7*a* are open at the sides of the rollers in order to allow the end sections 5 to flow freely beyond the rollers; therefore it is possible to employ cylindrical rim blanks obtained from extruded tubes having wider tolerances of thickness and thus offering an economic advantage.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

We claim:

1. A method of manufacturing a wheel rim for a motor vehicle, comprising the steps of:

(a) cutting off a section of an extruded cylindrical metal tube to produce a hollow cylindrical rim blank (5), (b) subjecting the rim blank to a first step deformation in which only the central section (5*a*) of the blank is deformed radially inwardly, the diameter of the end sections 5(*b*) of the blank remaining substantially unchanged during the first step deformation, (c) subjecting the rim blank to a second step deformation in which only the edge portion (5*c*) of each end section (5*b*) is deformed radially outwardly, the diameter of each region (5*b'*) of each end section between its respective edge portion and the central section remaining substantially unchanged during the second step deformation, and (d) gauging the deformed rim blank to produce the finished rim.

2. A method as defined in claim 1 wherein during the second step deformation, the outermost part (5*d*) of each edge of the blank is bent into a U-shape, the U opening toward the axis of the rim blank.

3. A method as defined in claim 1 wherein the first step deformation is produced by rotating the blank wall between a pair of cooperating forming rollers (6 and 7), the central sections of the rollers being shaped to deform the central section of the blank, and the end sections (6*a* and 7*a*) of the rollers being parallel and defining spaces between them for accommodating the end sections of the blank, the spaces being open at the sides of the rollers to permit free endwise flow of the rim blank outwardly from between the rollers.

* * * * *